US006532962B1

(12) United States Patent
Walker et al.

(10) Patent No.: US 6,532,962 B1
(45) Date of Patent: Mar. 18, 2003

(54) SPINAL SUPPORT SYSTEM FOR SEATING

(76) Inventors: Brock M. Walker, 4095 Hullet Rd., Okemos, MI (US) 48864; Edward E. Timm, 6860 N. River Rd., Freeland, MI (US) 48623

( * ) Notice: Subject to any disclaimer, the term of this patent is extended or adjusted under 35 U.S.C. 154(b) by 0 days.

(21) Appl. No.: 09/634,844

(22) Filed: Aug. 8, 2000

Related U.S. Application Data

(63) Continuation of application No. 08/893,177, filed on Jul. 15, 1997, now Pat. No. 6,125,851, which is a continuation of application No. 08/289,372, filed on Aug. 12, 1994, now abandoned.

(51) Int. Cl.[7] ..... A61G 15/00
(52) U.S. Cl. ..... 128/845; 128/846
(58) Field of Search ..... 128/845, 846, 128/DIG. 23; 602/5, 19; 5/633; 297/284

(56) References Cited

U.S. PATENT DOCUMENTS

| | | | | |
|---|---|---|---|---|
| 1,510,187 | A | | 9/1924 | Martin |
| 1,667,626 | A | | 3/1928 | Epstein |
| 1,716,871 | A | | 6/1929 | Weldon |
| 2,139,028 | A | | 12/1938 | Mensendicck et al. |
| 2,219,475 | A | | 10/1940 | Flaherty |
| 2,255,464 | A | * | 9/1941 | Hall ..... 128/845 |
| 2,554,337 | A | | 5/1951 | Lampert |
| 2,663,359 | A | | 12/1953 | Wood |
| 2,756,808 | A | | 7/1956 | Eichorst |
| 2,769,485 | A | | 11/1956 | Shapiro |
| 2,831,533 | A | | 4/1958 | Pasquarelli |
| 2,855,986 | A | | 10/1958 | Engelen, Sr. |
| 3,024,784 | A | | 3/1962 | Monfardini |
| 3,138,404 | A | | 6/1964 | Newton |
| 3,145,054 | A | | 8/1964 | Sopko, Jr. |
| 3,189,917 | A | | 6/1965 | Sims |
| 3,288,525 | A | | 11/1966 | Cerf |
| 3,348,880 | A | | 10/1967 | Swann |
| 3,362,402 | A | | 1/1968 | Loeffel et al. |
| 3,497,872 | A | | 3/1970 | Mithcell |
| 3,501,197 | A | | 3/1970 | Burton |
| 3,512,835 | A | | 5/1970 | Flototto |
| 3,568,670 | A | | 3/1971 | Gaylord, Jr. |
| 3,642,319 | A | | 2/1972 | Berchicci |
| 3,657,739 | A | | 4/1972 | Holmes, Sr. |
| 3,713,657 | A | | 1/1973 | Presta |
| 3,717,143 | A | | 2/1973 | Johnson |
| 3,720,441 | A | | 3/1973 | Corchran |
| 3,740,096 | A | | 6/1973 | Bridger |
| 3,855,631 | A | | 12/1974 | Ettinger |
| 3,900,896 | A | | 8/1975 | Ackerman |
| 3,904,242 | A | | 9/1975 | Koepke et al. |
| 3,926,183 | A | | 12/1975 | Spiro |
| 3,927,665 | A | | 12/1975 | Wax |
| 3,964,474 | A | | 6/1976 | Fox |
| 4,034,747 | A | | 7/1977 | Leroy |
| 4,099,524 | A | | 7/1978 | Cueman et al. |
| 4,156,544 | A | | 5/1979 | Swenson et al. |
| 4,175,553 | A | | 11/1979 | Rosenberg |
| 4,219,193 | A | | 8/1980 | Newman |
| 4,338,685 | A | | 7/1982 | Laport, Jr. |
| 4,471,993 | A | | 9/1984 | Watson |
| 4,475,543 | A | | 10/1984 | Brooks et al. |
| 4,489,982 | A | | 12/1984 | Morrow |
| D277,316 | S | | 1/1985 | Meares |
| 4,501,023 | A | | 2/1985 | Bilberry |

(List continued on next page.)

*Primary Examiner*—Michael A. Brown
(74) *Attorney, Agent, or Firm*—Shook, Hardy & Bacon L.L.P.

(57) ABSTRACT

A spinal support device for applying a directed and concentrated force on the sacrum to position the sacrum and pelvis to thereby establish a desired spinal posture when in a seated position. The device provides isolatable force on the sacrum from the sacral base line downwardly to a bottom seat surface and for a width across an individual's back approximately equal to twice the dimension of the posterior portion of the individual's sacrum.

32 Claims, 8 Drawing Sheets

U.S. PATENT DOCUMENTS 4,502,728 A 3/1985 Sheldon et al.
4,516,568 A 5/1985 Baxter et al.
4,522,447 A 6/1985 Snyder et al.
4,535,495 A 8/1985 Oldfield
4,556,254 A 12/1985 Roberts
4,559,933 A 12/1985 Batard et al.
4,572,578 A 2/1986 Perkins
4,572,782 A 2/1986 Perkins
4,576,154 A 3/1986 Hyman et al.
4,597,386 A 7/1986 Goldstein
4,634,176 A 1/1987 Scott
4,638,510 A 1/1987 Hubbard
4,643,174 A 2/1987 Horiuchi
4,715,362 A 12/1987 Scott
4,718,724 A 1/1988 Quinton et al.
4,753,478 A 6/1988 Weinreich
D296,930 S 7/1988 Carabelli
4,757,554 A 7/1988 Blair
4,789,202 A 12/1988 Alter
4,821,339 A 4/1989 Fair
4,824,169 A 4/1989 Jarrell
4,836,194 A 6/1989 Sebastian et al.
4,854,306 A 8/1989 Pujals, Jr.
4,862,536 A 9/1989 Pruit
4,870,705 A 10/1989 Higby et al.
4,876,755 A 10/1989 Parrish
4,881,529 A 11/1989 Santos
4,926,845 A 5/1990 Harris
4,930,499 A 6/1990 Rowe
4,981,325 A 1/1991 Zacharkow
4,996,720 A 3/1991 Fair
5,054,854 A 10/1991 Pruit
D321,760 S 11/1991 Carney
D325,087 S 3/1992 Brinker
5,105,806 A 4/1992 Woodhouse et al.
5,114,209 A 5/1992 Dunn
5,188,585 A 2/1993 Peters
5,190,347 A 3/1993 Shiow-Lan
5,201,761 A * 4/1993 Serola ..... 128/845
5,314,235 A 5/1994 Johnson
5,520,624 A * 5/1996 Amato ..... 602/19
5,586,561 A * 12/1996 Archer ..... 602/19

* cited by examiner 10
12
14
16
18
20
22
24
26
28
30
32
34
36
38
39
40
42
44
46
48
50
52
L-1
L-2
L-3
L-4
L-5

SPINAL SUPPORT SYSTEM FOR SEATING

This is a continuation of application Ser. No. 08/893,177, filed Jul. 15, 1997, now U.S. Pat. No. 6,125,851 which is a continuation of application Ser. No. 08/829,372, filed Aug. 12, 1994, now abandoned.

BACKGROUND OF THE INVENTION

1. Field of the Invention

The present invention relates to an improvement in a back support system that establishes a desired postural position by creating specific sacral pressure and to apparatus that will properly position the sacrum, the pelvis, including the iliac crests, and the supporting neuro-musculo-skeletal system to produce total pelvic stability.

2. Description of the Prior Art

Back pain, in concept and in fact, is not only prevalent in society but is an area of much research and patent activity. Back pain is something many individuals experience at work, at home, and during the trip therebetween. Back pain has many causes, but few cures. The latter is not for a want of trying. Rather, patents on a wide variety of back supports or support systems abound.

For example, the patents can be generally divided in groups including those relating to seat developments, sacral or lumbosacral braces, fixed cushions or supports, and inflatable devices.

The seat development area can be further subdivided into built-in supports, add-on supports, orthopedic seats, back rests, and office chair designs.

Prior to a summary review of these prior efforts, it should be understood that non-pathogenic back pain usually results from the presence of stress on the pressure on the neuro-musculo-skeletal system and affected interrelated anatomical structure. Sometimes that stress or pressure is generated internally within the spinal cord. In either case, the resulting stress can be due to inappropriately applied pressure or due to a distorted or damaged spinal column that has existed for varying periods of time, with resulting pain depending on the prior state of the spinal cord. Consequently, in many situations the neuro-musculo-skeletal system can be supported to either relieve or prevent development of unwanted and undesirable spinal pressure.

An early spine support device is described in Epstein, U.S. Pat. No. 1,667,626. A wooden frame is used to mount a series of spring bands that form a curved face. A batting material fills the space between vertical braces and the whole device was covered with fabric. Using adjustable hooks the device was adjustable to accommodate different sized persons. The device has a width about equal to a person's back and is shown being positioned in the lumbar region to provide uniform support over a broad region.

The built-in devices are exemplified by Sopko, Jr. U.S. Pat. No. 3,145,054 and Burton, U.S. Pat. No. 3,501,197. Sopko relates to a portable chair that incorporates a contoured pneumatic cushion which applies pressure to the posterior surface, in the sacroiliac area, and varies the pressure by forward and rearward movement of the occupant against the back supporting pneumatic cushion.

Burton attempts to restrict the body's movement into the back/seat junction area, where the ischial tuberosities of the pelvic girdle wedges into this back/seat area, by incorporating a rigid back/seat element into the seat to prevent such wedging.

The add-on devices include a variety of devices as shown in U.S. Pat. No. Weinreich 4,753,478; U.S. Pat. No. Quinton et al. 4,718,724; U.S. Pat. No. Baxter et al. 4,516,568; U.S. Pat. No. Scott 4,634,176; and U.S. Pat. No. Pasquarelli 2,831,533.

Each of these devices includes a portion that extends across the entire back of the person as seated in the seat. In Weinreich the support is in the form of a pair of tubular cushions. Quinton et al. suggest that it had proved difficult to standardize the location of lumbar support cushions and thus developed a vertically adjustable lumbar support cushion. Baxter et al. disclose a multi-compartment air bladder, including side and center sections, so that air pressure can be applied on selected lumbar and sacroiliac areas of the body. Scott is also a vertically movable back support but has a greater area than that to Quinton et al. Pasquarelli discloses use of a dorso-lumbar curve support in the form of an elongated cushion that applied pressure across the full width of the person's back.

The lumbosacral braces include Rowe, U.S. Pat. No. 4,930,499; Brooks et al., U.S. Pat. No. 4,475,543; Hyman et al, U.S. Pat. No. 4,576,154; Carabelli, U.S. Pat. No. Des. 296,930; and Lampert, U.S. Pat. No. 2,554,337.

Several patents disclose use of a fixed cushion. These include Parrish, U.S. Pat. No. 4,876,755; Snyder et al, U.S. Pat. No. 4,522,447; and the Meares design patent, U.S. Pat. No. Des. 277,316. The cushion used by Parrish is shaped as a capital "I" and supports the cervical, thoracic and lumbar regions. Snyder et al. designed foam cushions with segments having varying degrees of elasticity to provide inversely proportional support for both seating and backrest surfaces with the softest material provided where pressure would be highest.

Meares shows a design for an orthopedic device that provides full sacral pressures. The design patent does not explain how this device works or functions. However, an associated instruction book explains that the device is to be used by a person primarily in a horizontal condition. The device, while constructed from rubber in soft foam rubber, has a hollow interior and the edges are stiffer due to the presence of sidewalls that surround the hollow interior. Thus, the resistance provided by the Meares device is not uniform. The center is softer than the peripheral edges.

To use the device while lying on the floor, the device is placed on the floor and the user then rolls over onto the device. The instructions explain that the device has a wide end and a narrow end with the wide end being positioned so that it points toward the head. When one first gets on the device, the knees are to be bent and the tail bone is to be rocked down toward the floor. This movement is claimed to help position the curve of the sacrum (tailbone) into the curvature or cradle formed in the device.

As shown in the design patent, the device includes two raised portions on the anterior surface and a flat rear or posterior surface. Because the device is molded from soft rubber, and has a hollow interior, a wider cradle area is formed between the two raised areas.

The Meares device is about 7.25 inches long and has a width of 2.75 inches at the top and about 1 inch at the bottom. The upper raised area extends for about 2 inches, the cradle area then extends for another 3.25 inches with the lower raised portion extending for about 0.75 inches. Thereafter the device slopes toward the narrow end. The device should be used on a firm surface and the instructions suggest that a book could be used if the person was bedridden or a piece of plywood could be positioned under the hips to provide the feeling of a firm support.

The Meares instruction materials also state that his device can be used in a car, truck or a straight back chair. To use the Meares device in such a situation the rubber device is bent into a curved shape and then it is placed both under and slightly behind the person. The instructions also state the seat cushion is soft, a bendable book could be inserted under the rubber device to increase lift. The bent member should cradle the sacrum as when the device was used on the floor.

Thus, Meares suggests, indeed requires, full sacral pressure that is not adjustable with respect to the intensity of pressure being applied. Meares preference is to create constant pressure while the user is in a supine position.

It is also important to note that Meares isolates pressure along the full length of the sacrum. This is intended to provide a treatment to an injured set of muscles, with the piriformis and psoas muscles being of primary concern. Meares' desire is to literally move the whole of the sacrum upwardly (when lying down—movement is toward one's front). If the sacrum can be moved that way, and the hips are allowed to move in the opposite direction, that is, in a sense, to fall downwardly over the sides of his device, both the piriformis and psoas muscles will be stretched to relieve muscle spasms.

SUMMARY OF THE INVENTION

To gain an appropriate understanding of the utility and effect of the present invention, it is important to first understand the skeletal features of a human body, as well as how such features interact and affect one another. In that regard, reference will be made to the entire neuro-musculo-skeletal system of the human anatomy, as well as the interaction between those anatomical systems.

In a normal person, the spine, when viewed from the front, preferably will form a relatively straight vertical line. The function of the spine is in part mechanical, since it supports the body from the waist up, and in part protective, since it protects and houses the central nervous system or spinal cord. The spine is comprised of seven cervical vertebrae, twelve thoracic vertebrae and five lumbar vertebrae. Below the lumbar vertebrae is the sacrum and below that the bones that form the coccyx. The upper one third of the sacrum is an area identified as the sacral base.

The cervical or upper portion of the spine generally curves forward as a smooth and flexible "C" shaped element which supports the head and a percentage of body weight. This upper portion, because of its high flexibility, allows for rotational movement as well as fore and aft movement.

The thoracic portion of the spine, sometimes referred to as the middle back, will curve in the opposite direction, that is, rearwardly and then forwardly again. The thoracic portion supports the rib cage and the upper body portion above that area. Because the ribs are connected to the thoracic portion of the spine, the ribs themselves prevent the thoracic spine region from being as flexible as the cervical portion, and in fact, make the thoracic portion relatively rigid.

The next portion of the spine, the lumbar region or lower back, again curves in the opposite direction from the curvature of the thoracic portion. The sacral and coccyx portions extends therebelow and again curves forwardly. The lower back portion is supports the major portion of the upper body and, consequently, is under more compressive stress than the remaining portions of the spine.

The most normal curves of the spine are developed when the human body is standing in an upright manner and exhibiting good posture. As the body undergoes changes when getting into a seat and when seated, especially if one is to perform functions while in a seated position, the normal curvature of the spine is generally distorted. This is due to the fact that many, if not most, chairs do not give good spinal support. Consequently, backaches or stresses develop during sitting, especially during extended periods of sitting. Such extended sitting can create aches, soreness and disfunction.

This is true for the common man as well as in specialized instances, such as when race drivers must remain seated in the one position for hours at a stretch.

Thus, one of the principal objectives of the present invention is to support the lumbar lordosis of the spine in a shape similar to the shape found in a normal standing posture, and to provide this support when the individual is seated. One objective of the present invention is to support, principally, the sacral base. The goal is to prevent muscles from spasming by providing support and thus reducing the likelihood of muscle fatigue.

In Bridger, U.S. Pat. No. 3,740,096, there was a recognition that abnormal strains of the spine can be reduced if the occupants weight is distributed throughout each disc and vertebrae in the spine evenly so that a mechanical balance is created between the related antagonistic muscle groups and ligaments. While Murrow, U.S. Pat. No. 4,489,982 and Dunn, U.S. Pat. No. 5,114,209, recognized the importance of correct posture when sitting, they suggested use of full width back or lumbar supports. Neither recognized the importance, or even the desirability, of localized pressure, especially to the sacral base region.

The discs within the spine, separating the vertebrae, are under minimal mechanical load when bearing only compressive stresses resulting from the body's weight. However, when the spine is flexed from its normal curvature, such as when standing erect with good posture, the discs then must bear additional compressive and/or tensile stresses due to forces applied by the muscles and ligaments in order to maintain the mechanical equilibrium when the spine is in a new flexed position. It should be noted that the payload on the neuro-muscular-skeletal (NMS) system is vastly different between sitting and lying down positions.

A great deal of spinal pain can be traced to excessive stresses applied to these discs and to the vertebral complex and the interrelated neuro-musculo-skeletal system. Consequently, developing an improved seating approach requires that one minimize neuro-musculo-skeletal stresses when the individual is in a sitting posture. When this is achieved, it will provide superior comfort and endurance to the occupant of a seat and provide significant benefit during extended sitting periods.

Many people must perform some function when in a seated position. If this were not the case then the goal of minimizing stresses on vertebral complex could be accomplished relatively simply by inclining the back portion of the seat away from the vertical position to more closely approximate spinal curvature positions when the person was erect. However, tasks must be performed while seated. This necessarily requires upper body motion. As such motion occurs, it will create varying degrees of stress throughout the neuro-musculo-skeletal system. This is caused by the movement of muscles and ligaments associated with the body motion as movement occurs when the body changes position. Related stresses can also be aggravated by movement, especially when compared with stresses found in a perfectly static seated posture. Motion moves the upper body from its center of gravity, or from an equilibrium position established by the vertebrae, muscles and ligaments holding each vertebrae in the system change position and move in response. As the center of gravity changes, and the equilibrium position changes, this also increases bending moments around each vertebrae and thus discs are placed under additional, though varying, stresses.

When seated the major portion of the upper body, and certainly its center of gravity, is positioned above the fixed end of the spine. When bending of the spine takes it out of its columnar position, and thus out of equilibrium, motion occurs about a joint between the fifth lumbar vertebrae and the sacrum. Consequently, one objective of the present invention to stabilize and correctly orient this lumbo-sacral joint. This is important in providing a functionally active and comfortable seated position where the sacral base is supported. In that condition sitting can be endured for sustained periods. More specifically, if a seating device is arranged so that the sacrum, and in particular the sacral base, is not securely positioned at an angle that allows the spine to support the weight born by the fifth lumbar vertebrae, without requiring additional bending and shear stresses to maintain equilibrium of the spine, then no amount of additional support of the occupant's upper body will result in an optimally functional seat. It will also not provide sitting comfort for an extended time.

The present invention relates to a method and apparatus for supporting the lumbar lordoses of the spine to achieve a spinal shape similar to the shape found in a normal standing posture, but while seated. This is accomplished, in part, by securely locating a seated person's pelvis in a position that will maintain good spinal posture while seated. First, the sacrum itself must be properly positioned by locating the sacrum along its posterior surface. This is done by applying pressure directly over the posterior surface of the sacrum, and principally to the upper one third of the sacrum, the sacral base. Secondly, the force generated by such a sacral pressure exerting device must be resisted through a combination of frictional, gravitational or other mechanical means in order to prevent movement of the person in an anterior direction across the surface of the seat or away from the sacral support and away from the supporting force.

The sacral support of the present invention is designed to position the sacrum but to do so in a way that permits the ability to also compress adjacent soft tissue in a variable manner. The present invention permits the option to adjust the specific pressure to the sacral base and to change the pressures per square inch at that region. Thus, it is possible to vary the intensity of the specifically applied pressure to the sacral base to thereby achieve the support of and/or movement of the sacrum in a posterior to an anterior direction. This pressure can be directed against the individual at an angle that can vary from, for example, 15–20 degrees, plus and minus from a direction perpendicular to the sacrum. The most effective direction or angle will depend upon a number of factors, such as, for example, the shape of the seat, the angle of the seat back relative to the seat bottom, and the size of the person. However, the present invention can provide the desired sacral support, in a sitting condition, regardless of what position the seat is adjusted to with regard to its angle of incline.

Support of the seated individual is important since the payload on the neuro-muscular-skeletal system is quite different between sitting and supine positions. That payload difference also dictates muscle function without substantially compressing the adjacent soft body tissue in order to maintain a desirable sacrum base angle. The posterior surface of the sacrum is a relatively flat surface and is covered only with a minimum amount of soft tissue and muscle. Thus, it is amenable to be oriented by placing it in close proximity to an orienting surface. This orienting surface will preferably maintain a desirable sacral base angle of from about 20° to 50° from the plane of a substantially horizontal seat, but corrected for inclination of the spinal column from vertical, or for back rest inclination.

Other objects, features, and characteristics of the present invention will become apparent upon consideration of the following description in the appended claims with reference to the accompanying drawings, all of which form a part of the specification, and wherein referenced numerals designate corresponding parts in the various figures.

DETAILED DESCRIPTION OF THE PRESENT INVENTION

Figure 1:
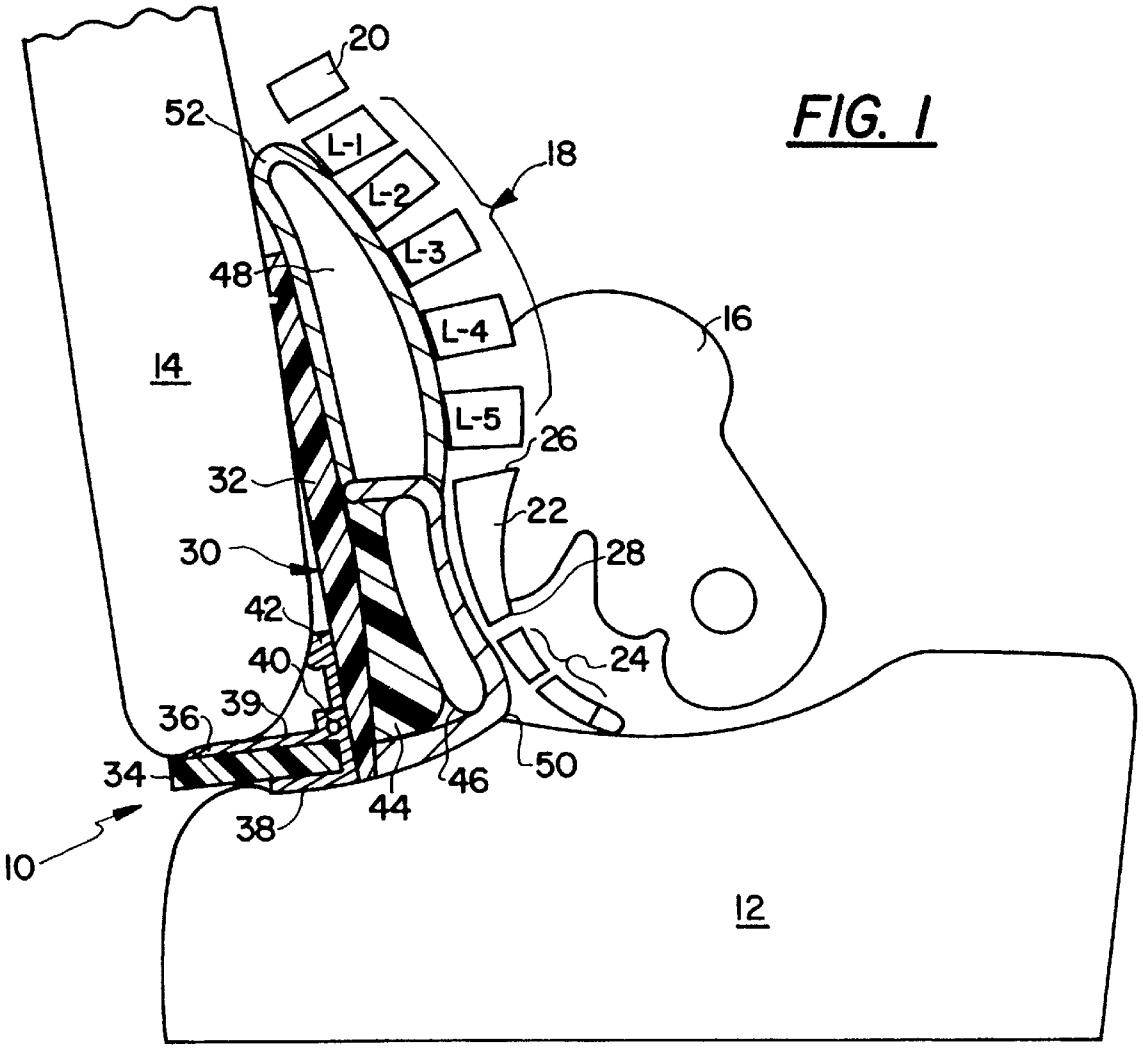
FIG. 1 is a cross-sectional view of the present invention with reference to a seat bottom and seat back, the lumbar vertebrae and the sacrum.

With reference to FIG. 1, one embodiment of the present invention is shown in cross-section, and generally indicated at 10. The device 10 is shown being used between a bottom seat 12 and a seat back 14, with only portions of the seat structure being shown.

In order to correlate the present invention and its effect on the anatomical components of a person's body, FIG. 1 includes the pelvis 16, the five lumbar vertebrae, generally indicated at 18, with the vertebras specifically referenced as L1–L5, respectively. A first and lowermost thoracic vertebrae is shown at 20. The sacrum is shown at 22 and the upper one third is the region or area called the sacral base. Below sacrum 22 is the coccyx 24, which is comprised of a series of smaller bones that, as a group, tend to curve in an anterior direction. In older adults the smaller coccyx bones can actually fuse together and are considered to be a part of the sacrum.

As noted, the sacrum 22 includes a sacral base or baseline at the top one third of the sacrum, indicated at 26, and a sacral apex at the bottom thereof, indicated at 28.

The present invention can include a base structure, generally indicated at 30, comprised of a vertically extending back brace 32, a bottom member or bracket 34. The bottom member, as shown in FIG. 1, can be inserted between the seat back 14 and seat bottom 12 thereby supporting and positioning the invention relative to the seat. As will be pointed out hereafter, this bottom member can have various forms depending upon the configuration of the support device, the seat, or it could be built into a seat. The back 32 is preferably connected to the bottom member 34 by a hinge 40 that includes hinge extensions 36 and 38. This hinge structure can be attached to the back and bottom members by any convenient means, such as glue, epoxy, bolts or screws.

The present invention principally includes a block member 44. Block member 44 provides the support and ability to place localized force or pressure on the sacrum, and most directly on the sacral base. Block 44 is preferably comprised of a rigid material and is shown in greater detail in FIGS. 2 and 3.

It should be understood that this rigid support block 44 can be used by itself, with or without a cover and with or without the base described above. Block 44 could also include, or be provided with, various additional members attached to it, either removably or permanently. For example, attached to its anterior of front face could be a form of padding, or a hydraulic bladder, as shown in FIG. 1 at 46, or a combination thereof. The padding could be comprised of a textile material, either woven or knitted, a non-woven material, batting, a foam layer, a gel filled bladder or other man-made or synthetic padding or body conforming materials. The goal is to provide an area of localized force but to simultaneously minimize the developed of points of contact. The preferred effect from the use of block 44 is to provide sufficient force or pressure on the sacrum, without substantial compression of adjacent soft tissue, and to develop the desired control over pelvic rotation. The padding or surface material on block 44 will also aid in isolating out or damping vibration to the sacrum.

In situations when block 44 is to be used by itself, a rearwardly extending seat support or engagement flap, preferably flexible, could be provided as described in more detail hereafter. This flap would slide between the seat lock and bottom cushions to allow proper placement of the block on the seat and to hold the block in place.

Block 44 should itself preferably be stiff enough so that it will not bend or flex, easily or substantially, nor be easily moved from its predetermined position in the seat. It can be constructed, fabricated or molded from a variety of materials including plastic, reinforced plastic, rigid foam, metal or other similar materials. Further, this invention is intended to encompass use of a curved member that will, in use against the posterior of an individual, flatten or conform to the shape of the sacrum under a 1–4 psi load.

Where a hydraulic bladder is used as the padding 46, it is preferably filled with an inert liquid, having a viscosity varying from about 0.01 to about 10,000 poise at 20° C. Such material may include flowable gels or thixotropic gels. Also, the bladder could be pneumatic and employ a fixed or variable volume of air or other inert gas. Where a variable volume of gas is desired, use of a conventional pneumatic pump, either hand operated or as part of an automatic system, could be used. Because these are conventional, further description is not believed required.

The desirability from using such bladder or members is to provide both a degree of protection for the individual, prevent development of point forces and to dampen the effect of any shocks during use. Also, use of the volume adjustable bladders allows the intensity of the force provided by block 44 to be adjusted.

As another alternative, the rigid block could have its anterior or front face covered with "CONFOR" foam, a type of material that is designed to conform to shapes placed against it. The bladder could also be filled with water or a gel that would protect the soft tissue and dampen movement and vibrations.

Figure 2:
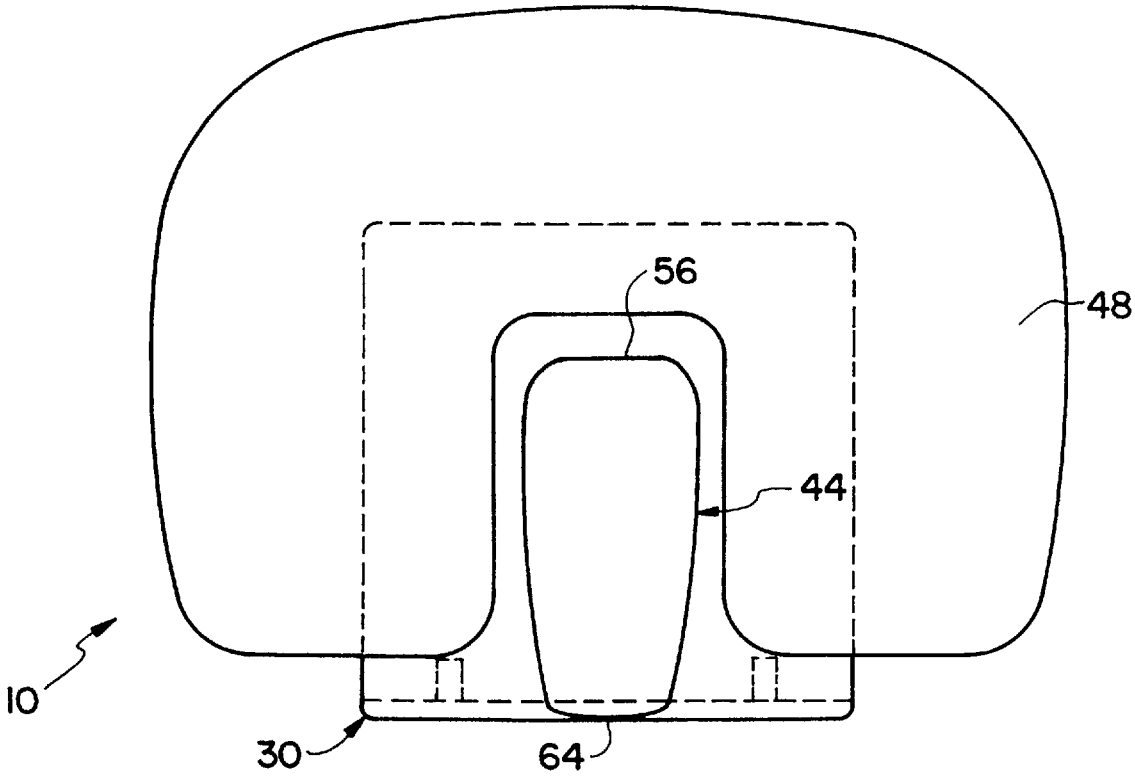
FIG. 2 is a front elevational view of the present invention.

Positioned above the rigid sacral support block 44, and the padding 46, is an additional support member 48, which has a generally U-shaped form as shown in FIG. 2. The surrounding support 48 can be a fluid filled bladder or foam and is preferably designed to provide lumbar and muscle support specifically for the supra-pelvic muscles and para-vertebrae muscles. However, the area of support 48, which can be about 100 square inches but can vary from 20 $in^2$ to 200 $in^2$, preferably provides less anterior pressure than does block 44. For example, the support 48 could be about 10 inches high and 12 inches wide but its dimensions could vary from about 5 to about 20 inches in height and from about 6 to about 24 inches in width. The ratio of anterior pressures applied by block 44 relative to support 48 will be preferably about 2:1, but could vary from about a 1.1:1 ratio to about a 10:1 ratio.

The amount of anterior force preferably exerted by the whole assembly to the sacrum, and primarily the sacral base, will range from about 20–40 pounds in a seat belt type car seat environment. The applied force in an office chair configuration will be about 10 pounds since only friction and gravity can resist the application of anterior forces. These forces could also range from 10 to 50 pounds in a car seat environment and from about 5 to about 25 pounds in a fixed or office type chair.

A cover 50 can be provided over the rigid sacral support 44 and the padding 46. A cover 52 could also be provided on the exterior of the support 48. It would also be possible to have one cover extend over the whole assembly. Such a cover could be loose or a shrink-wrap type conforming cover.

While the device as shown in FIG. 1 is a separate unit that can be easily placed into position by sliding the bottom bracket 34 in between the seat back and the seat bottom, with similar easy removal of the device 10, this structure could also be built into the seat back 14. In that case, the covers 50 and 52 would be replaced by the main cover for such a seat.

Figure 3:
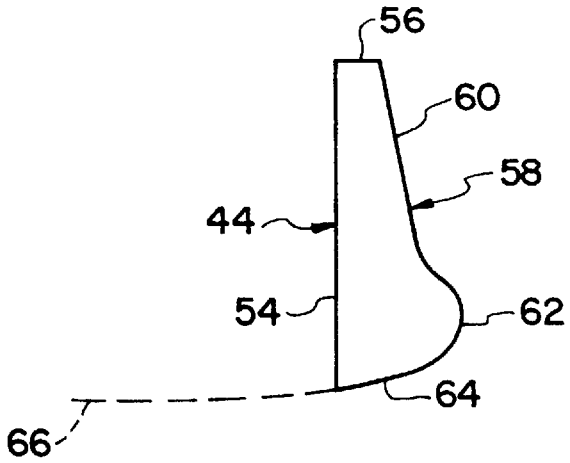
FIG. 3 is a side view of the rigid sacral support.

As shown in FIG. 3, the rigid sacrai support block 44 includes a rear surface 54, a top surface 56, and a front or anterior surface generally indicated at 58. That front surface 58 includes both a sloped or slightly curved upper portion 60 and an enlarged or bulbous portion 62 adjacent the bottom or in the lower portion of block. This latter enlarged portion extends anteriorly of forwardly beyond the upper portion 60. The surface below portion 62 is also sloped rearwardly to form a bottom surface 64. What is important is that the front or anterior surface 58 provide specific pressure contact, along a relatively narrow side-to-side path along the spine, in the area of the sacrum and specifically along the posterior surface thereof so that localized force is applied to the sacrum, and in a most preferred embodiment proportionally greater force will be applied to the sacral base portion of the sacrum. If the anterior surface 58 has a sufficient elongated curvature the bulbous portion could be subsumed, in a more gradual curve, within the overall curvature of that surface still extending outwardly at the bottom so that the whole sacrum will be supported yet supporting forces will still be concentrated on the sacral base. As the upper portion 60 of front surface 58 is more of a ramp or slope, then the desired lower sacral pressure will come from the bulbous portion 62.

As can be seen by comparing FIGS. 1 and 3, the front face 58 has a shape that will generally conform with or mimic the shape of the posterior shape of the sacrum.

The sacral support block 44 is designed, as a rigid structure, to localize the placement of pressure, or the desired supporting and corrective force, directly on the sacrum. In the most preferred embodiment, this force is concentrated on the upper one third of the sacrum, the sacral base. In each of the various embodiments, however, the sacral support block 44 is designed to apply force in a way that concentrates specific pressure or forces on and along the sacrum, that is along a narrow path relative to other parts of the back or posterior, specifically relative to the tissues adjacent the spinal column.

When block 44 is used by itself, the block 44 can also include a flexible, rearwardly extending tether, shown in dotted line at 66. Such a tether allows the block to be used by itself, without the additional bladder 48, and to be positively positioned and held in a seat or chair. The block and tether 66 are easily positionable so that an individual can place block 44 at the point it is needed and tether 66, by sliding between the seat and back, will hold it in that position. Tether 66 can be made of any flexible material, preferably plastic, but a textile material, such as a stiff length of woven or knitted synthetic yarn, could be used as well. Also, tether 66 could be molded integrally together with block 44 or, alternatively, tether 66 could be separately constructed and then attached to block 44 by any convenient method.

As referenced previously in some embodiments the sacral support block 44 works in conjunction with an outlying bladder 48 so that parts of the individual's back, adjacent the sacrum, can be supported in specific relationship to the support provided by and the force being applied by the sacral block. When the fluid volume of bladder 48 is adjustable, the force applied by block 44 can be adjusted. This, in turn, will develop the appropriate positioning of the pelvis and the lower portion of the spine to best minimize compressive, bending and shear forces in the spine when seated.

The sacral support block 44 does not extend across a large portion of the width of an individual's back. Similarly, it does not extend across a large portion of a seat back. Rather, it concentrates the application of pressure or force along a relatively narrow band and thus isolates the application of the desired force and support to a relatively narrow area. While not essential, it is preferred that the sacral support block 44 have a shape that is larger across its width at the top and narrower at the bottom. This produces a block having a generally inverted triangular shape.

The dimensions of the rigid sacral support 44 can be, for example, approximately 2½ inches in width across the top surface 56, as seen in FIG. 2, with approximately a width of the bottom 64 of about 1 inch. The overall height, from the bottom surface 64 to the top 56, can be, for example, about 5 inches.

With reference to FIG. 3, the front to back thickness across the top surface 56 from the rear surface 54 to the front sloped surface or ramp 60 is about 0.75 inch, whereas the forwardmost portion of the enlarged area 62 from rear surface 54 is about 1.5 inch.

The size ranges for the sacral support block 44 will vary according to an individual's height, with the following table showing roughly the dimensions for a small adult frame weighing about 150 lbs, a normal adult size frame weighing about 150–190 lbs and a relatively large adult frame weighing more than about 190 lbs.

| | Small | Normal | Large |
|---|---|---|---|
| Height | 3.5 | 5.0 | 6.5 |
| Top Width | 1.7 | 2.5 | 3.25 |
| Bottom Width | 0.7 | 1.0 | 1.3 |
| Top Thickness | 0.5 | 7.5 | 0.75 |
| Bottom Thickness | 1.0 | 1.5 | 2.0 |

For this rigid sacral support block the top to bottom width ratio is about 2.5:1 but could range from 1.5:1 to about 3:1. Likewise, the top to bottom thickness ratio is inverse to the width and is preferably about 1:2 but could range between 1:1 and 3:1 depending on the inclination of the device from vertical.

However, the top width of this distance could vary from 3 times the width of the sacrum at the sacral base to a dimension approximately equal to the width of the posterior portion of the sacrum still at the level of the sacral base and decrease progressively to the bottom of the block where the width is greater than or equal to the width of the sacrum at that point.

Figure 6:
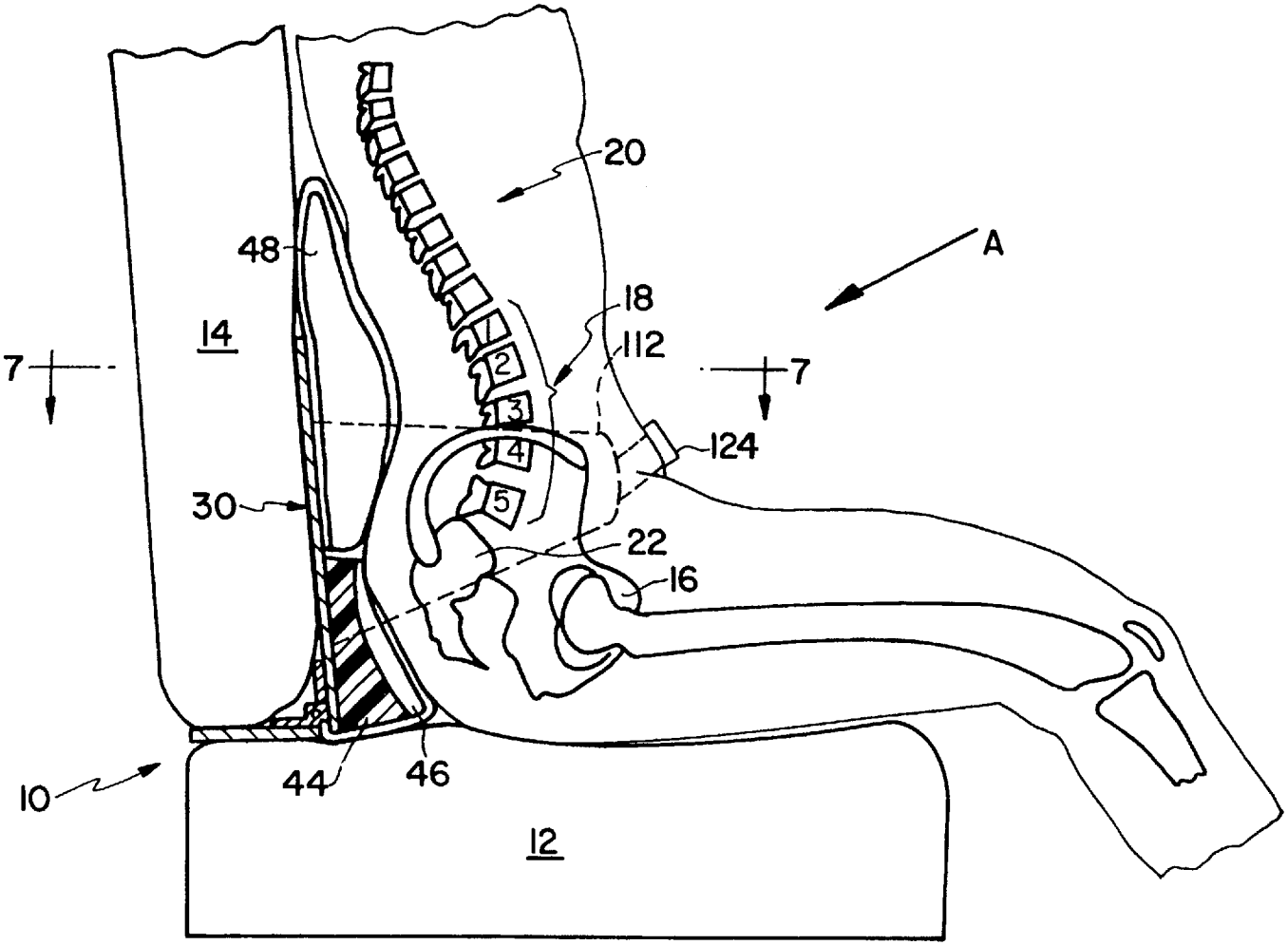
FIG. 6 is a cross-sectional view of another embodiment of the present invention.

As noted previously, the front surface 58 includes the sloped or curved portion 60 and a bulbous portion 62 or an elongated curvature, such as, for example, is shown in FIG. 6. FIG. 1 shows that the top surface 56, when block 44 is positioned on a seat in its preferred location and an individual is seated back in the seat, will be located approximately at a level with the sacral base line 26. Block 44 will extend downwardly from that point to the top of bottom seat 12 and the anterior surface 58 curves or extends forwardly in a progressive manner from top to bottom. This provides continuous and increasingly forwardly directed pressure on the sacrum which is itself curving forward away from the rear seat 14.

The block 44 is designed to preferably extend horizontally adjacent the sacral base line 26, a distance approximately equal to twice the width of the posterior portion of the sacrum. This is shown, for example, in FIG. 7. However, this horizontal distance could vary from 30% to 300% of the width of the posterior portion of the sacrum, measured at the sacral base, and decrease progressively to the bottom of the block where the width is about 30% to 300% of the sacrum width at the bottom of block 44.

We have found that when using a rigid sacral support 44 of the type just described fitted in an office chair, the support device will produce sacral pressures in the range of 1 to 2 psi, and that those pressures provide suitable pelvic stabilization. In most office chair configurations, only the combined mechanisms of friction and gravity will hold an individual back against the support block. Thus, forces greater than 1 to 2 psi will generally not be obtainable.

When the device according to the present invention is fitted in an automobile seat, however, where friction and gravity are aided by the additional presence of a seat belt, sacral pressures in the range of 2 to 4 psi can be generated with a corresponding greater degree of pelvic stabilization. Such pressures have been measured where the individual was seated in a static position. When an individual would be operating pedals, or move or be braced during cornering, those pressures will vary and can increase to 10 psi or more, depending upon the amount of exertion and vehicle speeds.

Air bladder 48 will generally be inflated to a pressure less than about 50% of the pressure exerted by the sacral pressure block 44. We have found that when the air bladder 48 is inflated to a pressure greater than about 50% of the pressure indicated on a sacral pressure gage for testing the amount of pressure exerted by the rigid support block 44, the sacral pressure losses its effectiveness in providing pelvis stabilization. For example, with an initial sacral pressure of 2 psi when seated, inflation of the air bladder 48 to 0.3 psi relieved the value of the sacral pressure applied by block 44 to downwardly to a value of 1.2 psi. This lower pressure still provided effective pelvic stabilization. However, when the air bladder was further inflated to 0.5 psi, the sacral pressure fell below 1 psi and pelvic support was no longer adequate.

Figure 4:
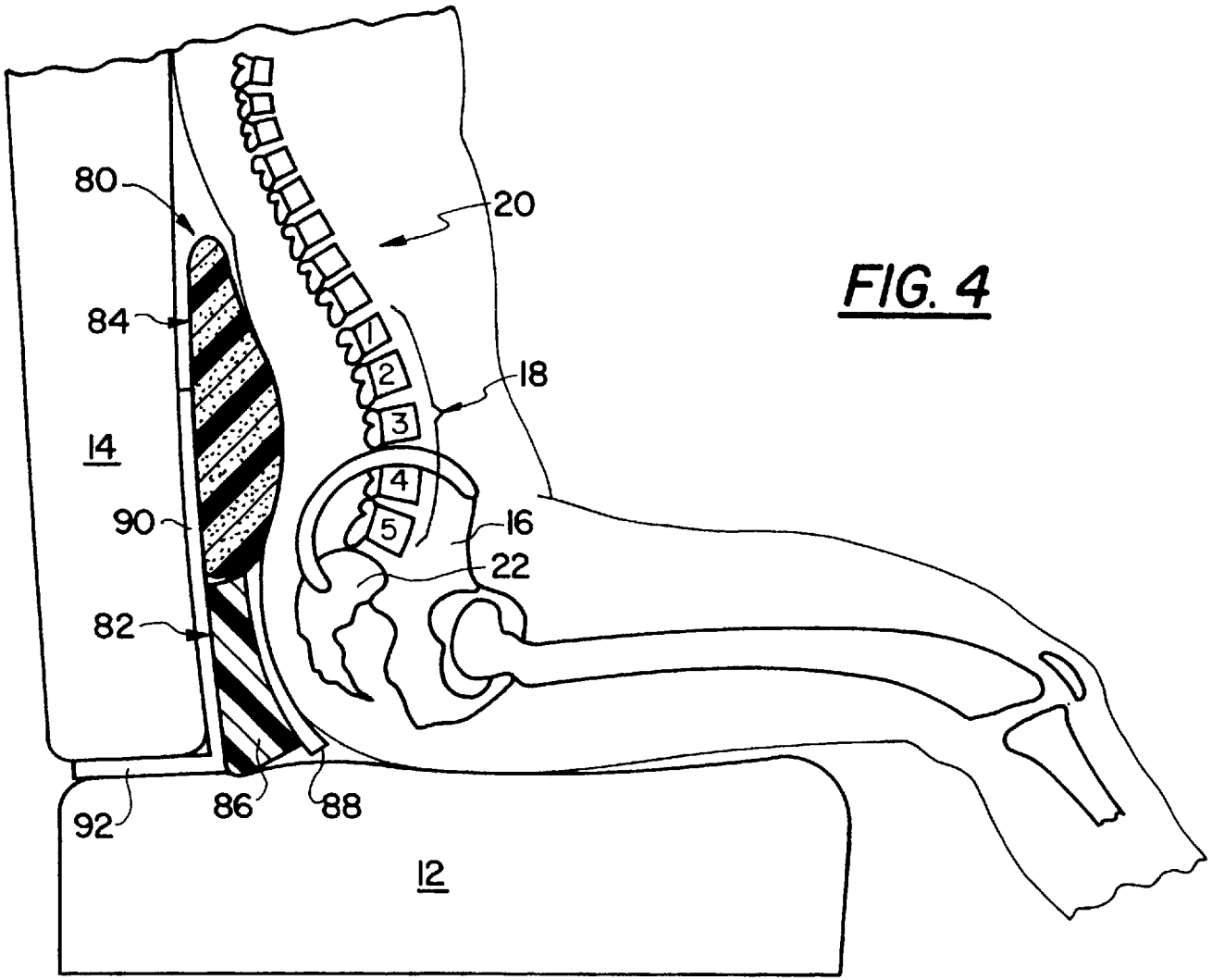
FIG. 4 is a cross-sectional view of a modified form of the present invention.

FIG. 4 shows a second embodiment of the present invention. This embodiment continues to show use with a car seat having a bottom seat 12 and a back seat 14. The pelvis is shown at 16, the sacrum at 22, the lumbar vertebrae at 18 while the thoracic vertebrae are generally indicated at 20.

In this embodiment, the device is generally indicated at 80 and includes a back support 82, an upper or exterior support 84 and a rigid support block 86. The rigid support block 86 can also be provided with a cover 88, although the latter is not essential. This cover can be either in the form of padding, a hydraulic bladder or a combination of those elements. As shown in FIG. 4 the cover 88 is a fixed volume, fluid filled bladder.

Figure 5:
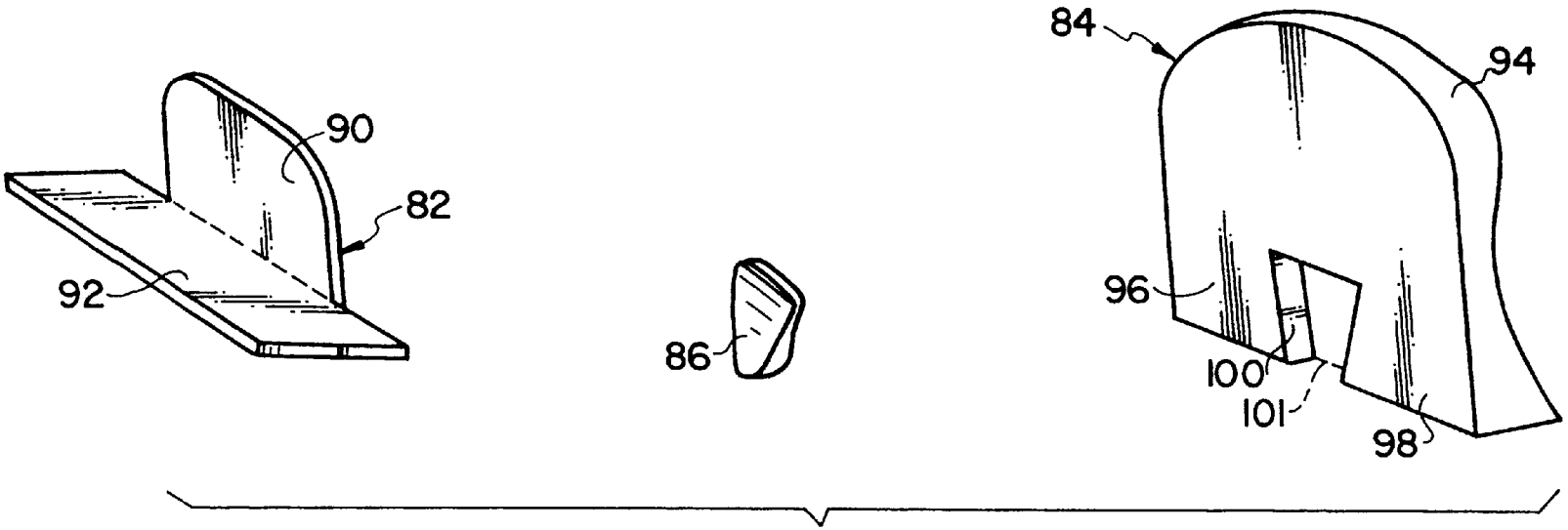
FIG. 5 is an exploded perspective view of the embodiment of the present invention shown in FIG. 4.

In this embodiment, the back support 82 is preferably a molded, one piece structure that is generally L-shaped, a perspective view of which is shown in FIG. 5. The back support 82 can included a vertical upright portion 90 and a rearwardly extending portion or tether 92. As shown, the back support 82 is formed as an integral one piece unit and can be constructed of a variety of materials, including plastics, semi-rigid or rigid foams or even metal. It is preferred, however, that the rearwardly extending portion 92 have some flexibility so that it can accommodate various shapes and curvatures that may exist between bottom and rear seats.

FIG. 5 also shows, in an exploded fashion, the upper and side support member 84, as well as the rigid support block 86.

The support 84 will again have a generally U-shaped form with an upper portion 94 and two side portions, 96, 98.

Cover 88 or block 86 could also be formed directly from the foam material used to produce the support 84. Such a cover could simply be an additional front surface left spanning across the interior side of opening 100 with the bottom of that cover structure being shown by dotted line 101 in FIG. 5.

Alternatively, cover 88 could be a padded textile material or, as with prior embodiment, a variety of other materials or combinations thereof.

Block 86 preferably has a shape and configuration similar to that previously discussed with respect to block 44. Here again, it is preferred that the block 86 be molded from plastic formed from another rigid material.

In use, the block 86 could be used with a reduced or smaller version of the support 82, or by itself, or it could be used in a combined fashion, as shown in FIG. 4, with the back support and the upper support 84. In the latter case the separate elements would operate collectively as a back and lumbar support assembly.

The foam used to produce support 84 would be of a resiliency or density suitable to provide some additional support for the individual in a lumbar area, but not so much a support that the specific pressure sought to be provided by block 86 was either relieved or not. For example, the foam used for member 84 could be polyurethane, EVA or foam rubber. Where foam is used a foam density preferably of about 2 to about 20 pound per cubic foot is preferred.

The size and dimensions of block 86 remain similar to those described above for block 44.

It should also be understood that the whole assembly 80 could be formed as an integral unit, and molded with varying densities of plastics or foams. This would result in a one piece structure that could be conveniently used by an individual, and even carried from one seating environment to another. In that way, the device could first be used in an automobile while travelling to and from work, and then carried into the office and next used in that individual's office chair environment to provide additional sacral support during the work day. After work, the device would again be used in the car for the trip home.

Figure 7:
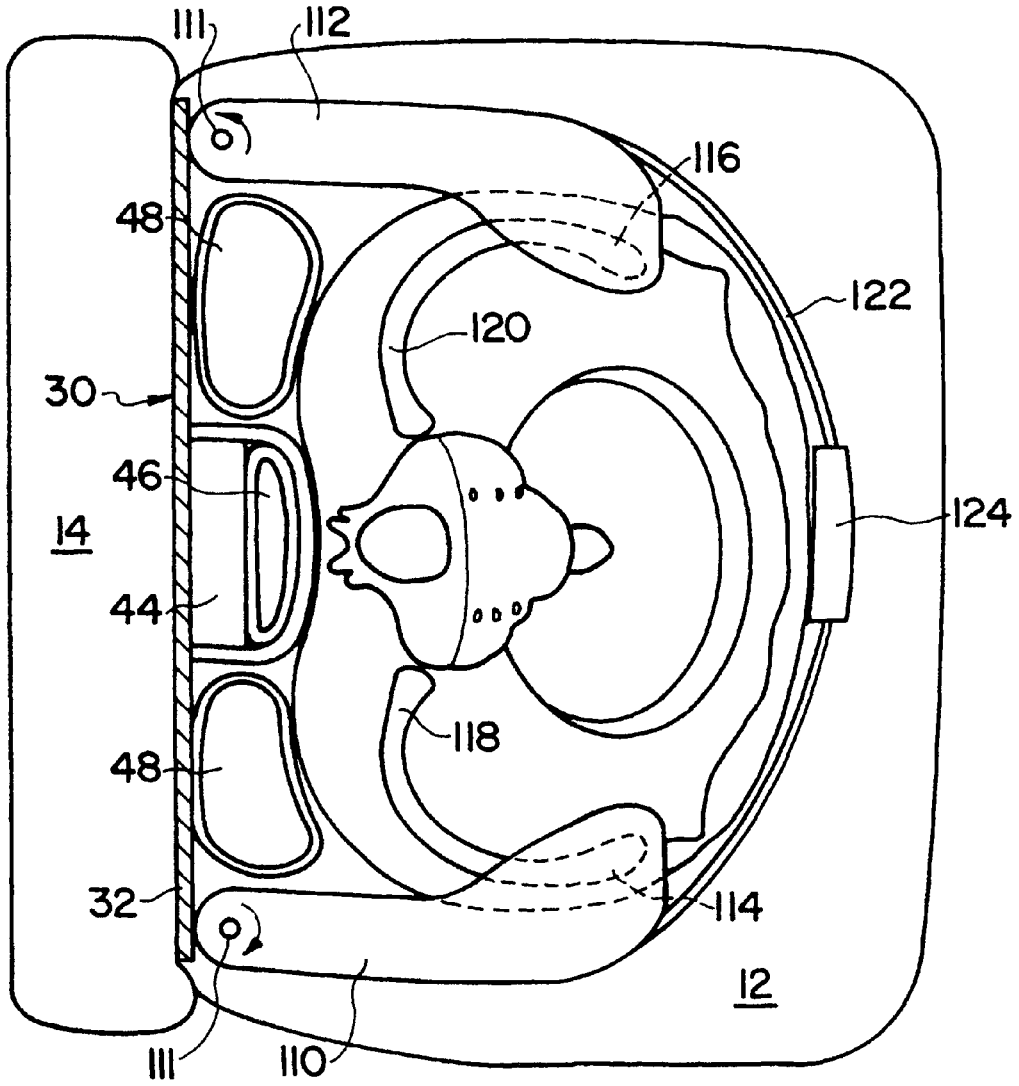
FIG. 7 is a cross-sectional view taken along line 7—7 in FIG. 6.

Another embodiment of the present invention is shown in FIGS. 6 and 7, and could be a modified version of either prior embodiment as shown in FIGS. 1–3 or FIGS. 4–5, respectively. The base support as shown, for example, could be the back support, generally indicated at 30.

The device that is shown being used with respect to the bottom seat 12 and the back seat 14 is the device generally indicated at 10 which includes a base member, generally indicated at 30, an air bladder 48, a rigid sacral support lock 44 with a hydraulic bladder 46 provided thereover. The difference between this and the FIG. 1 embodiment is the use of side bolsters 110 and 112. Bolster 112 is shown in dotted line in FIG. 6 and both are shown in the FIG. 7 top plan view. Bolsters 110 and 112 are pivotally connected as of 111 to the back brace 32 so that each bolster can pivot outwardly away from the individual, as shown by the arrows adjacent the pivot connections 111. This pivot 111 connection can be by hinge or other convenient mechanism (not shown in detail), the only requirement being that bolsters 110 and 112 be pivotable toward and away from an individual sitting on seat 12.

As shown in FIG. 7, each bolster can include an upward, inwardly curving portion shown at 114 and 116, respectively. These inwardly curving portions are designed so that they will come up over the hips of the seated individual, as shown in FIG. 7, and also allows them to extend over the iliac crests, shown at 118 and 120. The front portions of the side bolsters 110 and 112 are connected together by means of a lap belt 122 and a suitable buckle 124 which will permit the belt to be snugly tightened around the individual. This combined belt and bolster assembly will tend to apply pressure in the direction shown by the arrow A in FIG. 6. Belt 122, together with the bolsters 110 and 112, will capture the iliac crests of the seated individual and will thereby prevent movement of the pelvis.

This support system can also be used in a race type vehicle, which has a three to five point restraint system, to accommodate higher G force requirements. In this situation, the support elements could be customized for an individual driver and constitute part of an integrated, customized seat and support structure. The function and operation of the elements would be the same, however, the conditions, reactions and forces would simply be more severe.

FIGS. 9 through 12 show an additional embodiment of the present invention and one that is mechanically adjustable.

Figure 8:
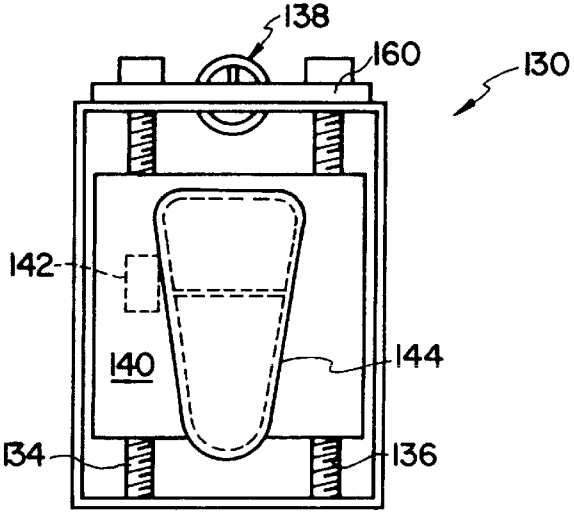
FIG. 8 is a front view of another embodiment of the present invention.

As shown in FIG. 8, the support apparatus, generally indicated at 130, is comprised of an outer frame 132 in which two pivotally mounted threaded rods, 134 and 136 respectively, are pivotally mounted. A rod drive assembly, generally indicated at 138, is provided to rotate rods 134 and 136. This operation will be described further below.

Figure 12:
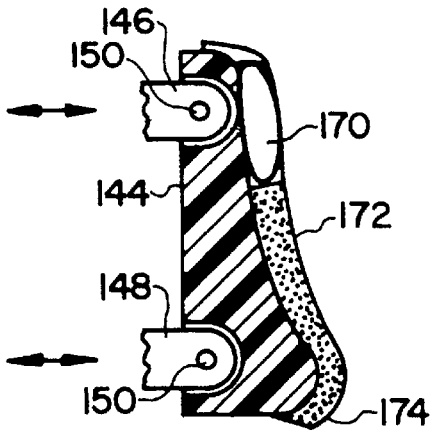
FIG. 12 is a vertical, partial cross-section through the support block.

A face plate 140 is connected to each of rods 134 and 136 by suitable threaded bearings, one of which is shown in phantom at 142. This permits face plate 140 to traverse vertically within frame 132. A sacral support block 144 is connected to face plate 140 by means of upper and lower supports 146, 148, respectively, which, as shown in FIG. 12, are connected to block 144 by pin connections 150. The pin connections 150 permit the ends of each support 146 and 148 to pivot and thus move relative to the sacral support block 144.

Figure 9:
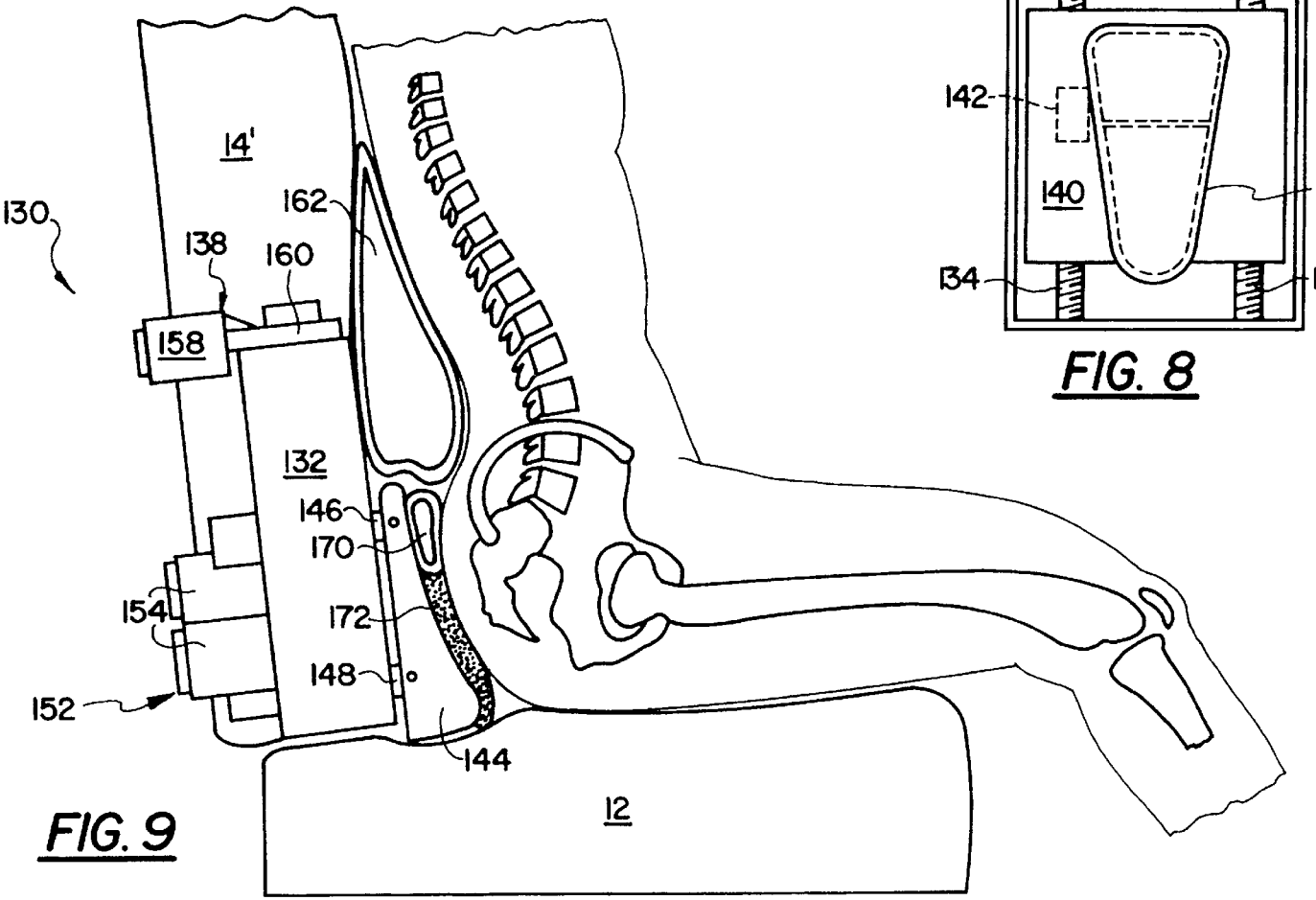
FIG. 9 is a side elevational view thereof as positioned in a seat relative to an individual.
Figure 10:
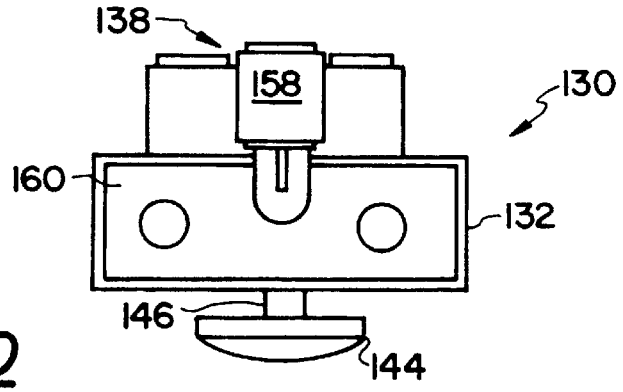
FIG. 10 is a top plan view thereof.
Figure 11:
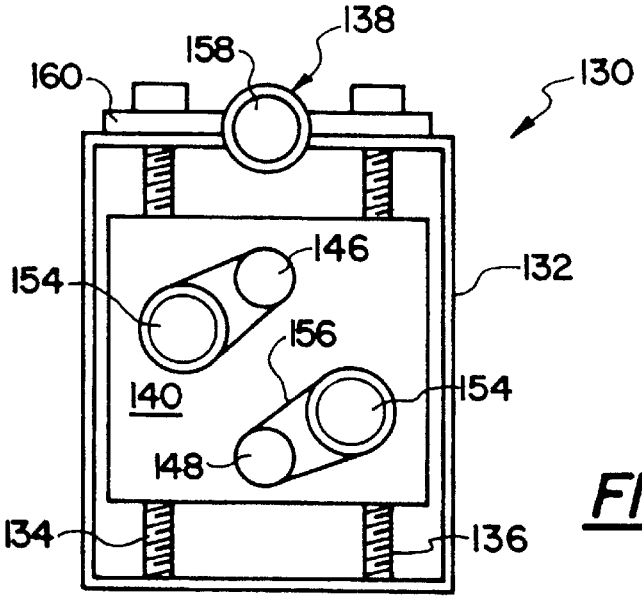
FIG. 11 is a front elevational view with the sacral support block removed.

Supports 146, 148 each extend rearwardly, through face plate 140, within frame 132, and into a suitable block drive assembly, generally indicated at 152. The upper and lower supports 146 and 148 can either comprise threaded rods, at least the interior end of which is threaded, or, alternatively, they can comprise piston rods. What is required is a way to permit block 144 to be manipulated or moved. The block drive assembly 152 is provided to move the block supports 146 and 148, either uniformly or unilaterally, inwardly and/or outwardly relative to frame 132. In this way, the sacral support block 144, or its upper or lower portion, can be moved toward and away from frame 132 and thus, as shown in FIG. 9, toward and away from an individual in a seat. Because block supports 146 and 148 can move independently of one another, it is possible to cause block 144 to articulate in a way designed to best provide support for an individual. Consequently, the top or the bottom of block 144 can be positioned so that the block itself can be located at varying angular positions, relative to each other and relative to the plane established by face plate 140 or the seat back 14'. Thus, block 144 can be positioned differently from the position as shown in FIG. 9.

The sacral support block drive system 152 can be comprised of one or more electric motors 154, which in turn drive suitable gear assemblies to cause the upper and lower block supports 146, 148 to move inwardly or outwardly, as shown by the double arrows in FIG. 12. Such a gear assembly is generally indicated at 156 in FIG. 11, and can include suitable gearing so that when operatively connected to drive motor 154 the block supports will be moved in a desired direction. This drive system could also be controlled in a way similar to the way car seats with finger controls can be moved, or via a memory system. These are now conventional and further description is not necessary.

Drive assembly 138 also includes an electric motor 158, as well as a suitable worm gear drive 160 that will connect directly to the tops of rods 134 and 136 and cause them to operate in a clockwise or counterclockwise direction.

The sacral support block 144 can be a rigid member or, alternatively, as shown in FIG. 12, could include a hydraulic bladder 170, located along the upper one-third of the support, with the lower two-thirds being covered by a foam pad 172. For aesthetics, a fabric cover 174 could extend over both the bladder 170 and the foam pad 172. In this configuration, the hydraulic bladder 170 is relatively incompressible whereas the foam portion, in the lower two-thirds, is compressible. It should also be understood that the hydraulic bladder 170 could have its internal volume adjustable, as in the earlier embodiments, so that the overall support could be adjusted for each individual user.

It should also be understood that this form of the support block 144 could be used by itself, as with blocks 44 and 86. Also, block 144 could be provided, in that case, with a tether similar to tether 66.

As shown in FIG. 9 the support assembly 130 could also include a larger fluid bladder 162 that would be similar to bladder 48 shown in FIG. 1. Consequently, further discussion of that bladder, and its utility in the support system of the present invention, is not required here.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A spinal support device for use with a seat having a back and bottom that are arranged to accommodate a sitting user, said spinal support device comprising:

a sacral support member having an anatomically conforming front surface configured to generally conform to the configuration of at least the sacral portion of the spine of the user, said sacral support member having sufficient rigidity so that positioning said sacral support member on the seat at a position corresponding to that of the sacrum portion of the user causes said sacral support member to apply support pressure to the sacral portion of the spine by concentrating force on and along the sacrum portion of the spine when the user is seated in the seat, said sacral support member having a width configured to extend across substantially only the sacrum portion.

2. A spinal support device as in claim 1, further comprising a padding member extending across at least a portion of said front surface.

3. A spinal support device as in claim 1, wherein said sacrum support member has a width extending in horizontal distance from 30% to 300% of the width of the posterior portion of the sacrum portion.

4. A spinal support device as in claim 1, wherein said sacrum support member has a top portion and a bottom portion, and wherein said top portion has a greater width than said bottom portion.

5. A spinal support device as in claim 4, wherein a ratio of the width of said top portion to the width of said bottom portion is in a range of from about 1.5:1 to about 3:1.

6. A spinal support device as in claim 4, wherein a ratio of the width of said top portion to the width of said bottom portion is about 2.5:1.

7. A spinal support device as in claim 6, wherein the width of said top portion is approximately 2.5 inches and the width of the bottom portion is approximately 1 inch.

8. A spinal support device as in claim 6, wherein the width of said top portion is in a range of from about 1.7 to 3.25 inches and the width of said bottom portion is in a range of from about 0.7 to 1.3 inches.

9. A spinal support device as in claim 4, wherein a ratio of the thickness of said top portion to the thickness of said bottom portion is about 1:2.

10. A spinal support device as in claim 1, further comprising a lumbar support member having an upper portion and downwardly extending side portions that collectively form a generally U-shaped configuration and define a pocket, said sacrum support member being received in said pocket of said lumbar support member so that said downwardly extending side portions are respectively positioned on opposite sides of said sacrum support member.

11. A spinal support device as in claim 10, wherein said lumbar support member is comprised of a fluid filled bladder or foam.

12. A spinal support device as in claim 10, wherein a ratio of an anterior pressure applied to the user by said sacrum support member to an anterior pressure applied to said lumbar support member is in a range of from about 1.1:1 to about 10:1.

13. A spinal support device as in claim 10, wherein a ratio of anterior pressure applied to the user by said sacrum support member to an anterior pressure applied to the user by said lumbar support member is about 2:1.

14. A spinal support device as in claim 10, wherein said downwardly extending side portions are respectively spaced from the opposite sides of said sacrum support member.

15. A spinal support device as in claim 1, further comprising a vertically extending back brace and a horizontally extending back brace that collectively form a general L-shape, wherein said vertically extending back brace extends adjacent posterior surfaces of said sacrum support member and said lumbar support member, and wherein said horizontally extending back brace extends rearward from adjacent a bottom surface of said sacrum support member.

16. A spinal support system comprising:

a seat comprising a seat back and a seat bottom arranged to accommodate a sitting user thereon;

a base structure comprising a back brace extending vertically along a portion of said seat back; and a sacral support member having a posterior surface facing said back brace and an anatomically conforming front surface configured to generally conform to the configuration of at least the sacral portion of the spine of the user, said sacral support member having sufficient rigidity so that positioning said sacral support member on said seat at a position corresponding to that of the sacrum portion of the user causes said sacral support member to apply support pressure to the sacral portion of the spine by concentrating force on and along the sacrum portion of the spine when the user is seated in the seat, said sacral support member having a width configured to extend across substantially only the sacrum portion of the spine, yet not across the entire width of said seat back.

17. A spinal support system as in claim 16, wherein said base structure further comprises a bottom bracket extending horizontally along a portion of said seat bottom, said bottom bracket serving as a base for providing support to said back brace.

18. A spinal support system as in claim 17, wherein said bottom bracket is inserted into a joint at which said seat back and said seat bottom meet.

19. A spinal support system as in claim 18, wherein said bottom bracket is hinged to said back brace.

20. A spinal support system as in claim 16, further comprising a padding member extending across at least a portion of said front surface.

21. A spinal support system as in claim 16, wherein said sacrum support member has a width extending in horizontal distance from 30% to 300% of the width of the posterior portion of the sacrum portion.

22. A spinal support system as in claim 16, wherein said sacrum support member has a top portion and a bottom portion, and wherein said top portion has a greater width than said bottom portion.

23. A spinal support system as in claim 22, wherein a ratio of the width of said top portion to the width said bottom portion is in a range of from 1.5:1 to about 3:1.

24. A spinal support system as in claim 22, wherein a ratio of the width of said top portion to the width of said bottom portion is about 2.5:1.

25. A spinal support system as in claim 21, wherein the width of said top portion is approximately 2.5 inches and the width of the bottom portion is approximately 1 inch.

26. A spinal support system as in claim 24, wherein the width of said top portion is in a range of from about 1.7 to 3.25 inches and the width of said bottom portion is in a range of from about 0.7 to 1.3 inches.

27. A spinal support system as in claim 22, wherein a ratio of the thickness of said top portion to the thickness of said bottom portion is about 1:2.

28. A spinal support system as in claim 16, further comprising a lumbar support member having an upper portion and downwardly extending side portions that collectively form a generally U-shaped configuration and define a pocket, said sacrum support member being received in said pocket of said lumbar support member so that said downwardly extending side portions are respectively positioned on opposite sides of said sacrum support member.

29. A spinal support system as in claim 28, wherein said lumbar support member is comprised of a fluid filled bladder or foam.

30. A spinal support system as in claim 28, wherein a ratio of an anterior pressure applied to the user by said sacrum support member to an anterior pressure applied to the user by said lumbar support member is in a range of from about 1.1:1 to about 10:1.

31. A spinal support system as in claim 28, wherein a ratio of an anterior pressure applied to the user by said sacrum support member to an anterior pressure applied to the user by said lumbar support member is about 2:1.

32. A spinal support device as in claim 28, wherein said downwardly extending side portions are respectively spaced from the opposite sides of said sacrum support member.

* * * * *